US009516908B2

(12) United States Patent
Miyatake et al.

(10) Patent No.: US 9,516,908 B2
(45) Date of Patent: Dec. 13, 2016

(54) WIG

(75) Inventors: Nobuyuki Miyatake, Tokyo (JP); Kumiko Saito, Tokyo (JP)

(73) Assignee: ADERANS COMPANY LIMITED, Tokyo (JP)

( * ) Notice: Subject to any disclaimer, the term of this patent is extended or adjusted under 35 U.S.C. 154(b) by 0 days.

(21) Appl. No.: 14/237,672

(22) PCT Filed: Aug. 2, 2012

(86) PCT No.: PCT/JP2012/069743

§ 371 (c)(1),
(2), (4) Date: Apr. 23, 2014

(87) PCT Pub. No.: WO2013/021918

PCT Pub. Date: Feb. 14, 2013

(65) Prior Publication Data

US 2014/0283862 A1 Sep. 25, 2014

(30) Foreign Application Priority Data

Aug. 8, 2011 (JP) ..... 2011-172678

(51) Int. Cl.
*A41G 3/00* (2006.01)
*A41G 5/00* (2006.01)

(52) U.S. Cl.
CPC ..... *A41G 3/0041* (2013.01); *A41G 3/00* (2013.01)

(58) Field of Classification Search
CPC ..... A41G 3/00; A41G 3/0041; A41G 3/0066; A41G 3/0083; A41G 3/0075; A41G 5/00; A41G 5/004; A41G 5/006
USPC ..... 132/53, 201
See application file for complete search history.

(56) References Cited

U.S. PATENT DOCUMENTS 2,814,301 A * 11/1957 Schmitz ..... A41G 5/0006 112/80.02
3,670,741 A * 6/1972 Utsunomiya ..... A41G 3/00 132/201
3,910,291 A * 10/1975 Kim ..... 132/53
3,970,092 A * 7/1976 Nelson ..... 132/201
(Continued)

FOREIGN PATENT DOCUMENTS

JP 53-141187 U 11/1978
JP 3-206108 A 9/1991
(Continued)

OTHER PUBLICATIONS

International Preliminary Report on Patentability, mailed Feb. 11, 2014, for International Application No. PCT/JP2012/069743, 5 pages.

*Primary Examiner* — Robyn Doan
(74) *Attorney, Agent, or Firm* — Seed IP Law Group LLP

(57) ABSTRACT

An object of the present invention is to surely provide a wig with hairs that ensures the desired voluminous feeling. A wig comprises an alternate arrangement, the alternate arrangement including: a first region of a wig base in which a plurality of first hairs having a first curl diameter are implanted, the first hair being an artificial hair or a natural hair; and a second region of the wig base in which a plurality of second hairs having a second curl diameter smaller than the first curl diameter are implanted, the second hair being an artificial hair or a natural hair, the first and second regions being adjacent to each other and alternately arranged.

9 Claims, 4 Drawing Sheets

(56) References Cited

U.S. PATENT DOCUMENTS

| | | | | | |
|---|---|---|---|---|---|
| 4,739,777 | A * | 4/1988 | Nelson | A41G 3/00 | 132/53 |
| 4,930,527 | A * | 6/1990 | Makishima et al. | 132/201 | |
| 5,044,382 | A * | 9/1991 | Ando | A41G 3/005 | 132/53 |
| 8,578,945 | B2 * | 11/2013 | Sasayama | 132/53 | |
| 2007/0251536 | A1 * | 11/2007 | Kupitz | 132/53 | |
| 2008/0041405 | A1 * | 2/2008 | Kitsu et al. | 132/201 | |
| 2009/0260649 | A1 * | 10/2009 | Sakurai et al. | 132/201 | |
| 2010/0229882 | A1 * | 9/2010 | Sotokawa | A41G 3/00 | 132/54 |

FOREIGN PATENT DOCUMENTS

| | | | |
|---|---|---|---|
| JP | 2006-183214 | A | 7/2006 |
| JP | 2007009338 | A * | 1/2007 |
| WO | 2011/040481 | | 4/2011 |

* cited by examiner

WIG

TECHNICAL FIELD

The present invention relates to wigs having artificial hairs or natural hairs implanted in a wig base, and more particularly to a wig having artificial or natural hairs with predetermined curl.

BACKGROUND ART

Most of wigs are formed by implanted artificial hairs or natural hairs, such as human hairs, in a wig base which is formed of an artificial skin made of synthetic resin, such as urethane, a net with meshes of synthetic fibers, or a combination of the artificial skin and the net.

Recently, among wigs made of the same amount of hairs (artificial or natural hairs) implanted, voluminous wigs tend to be required.

For this reason, the hairs implanted in the wig base are designed to be curled with a predetermined curl diameter (that is, the hairs are curled hairs). Such wigs are in widespread use.

The curled hairs with a relatively larger curl diameter tend to stand up substantially vertically from the wig base, and then to expand gradually transversely along the curl diameter, easily enhancing the voluminous feeling. The hairs with the larger curl diameter, however, have longer parts standing up from the base, which tends to cause the hairs to easily fall over due to a small external force, for example, even moderate wind. As a result, in some cased the desired voluminous feeling cannot be obtained.

On the other hand, the hairs with the smaller curl diameter have shorter parts substantially vertically standing up from the base, which can effectively prevent the hairs from falling over due to the small external force. However, the small curl diameter often makes it difficult for the hairs to obtain the desired voluminous feeling.

Patent Document 1 discloses a wig having hairs with different curl diameters mixed at a predetermined rate and implanted to improve its voluminous feeling.

CONVENTIONAL ART DOCUMENT

Patent Document

Patent Document 1: JP 2006-183214 A

SUMMARY OF THE INVENTION

Problems to be Solved by the Invention

The wig disclosed in Patent Document 1 includes the mixture of the hairs with different curl diameters. The standing parts (base ends) of the hairs with a large curl diameter are supported by the hairs with a small curl diameter to prevent the large curl diameter hairs from falling over.

However, from the viewpoint of the appearance, touch feeling, and styling, an appropriate range of toughness of the hairs is limited. In some cases, the support by the hairs with the small curl diameter is not enough, which causes the hairs with the large curl diameter to fall over, failing to obtain the desired voluminous feeling.

Accordingly, it is an object of the present invention to provide a wig with hairs that ensures the desired voluminous feeling by surely preventing the hairs with a large curl diameter from falling over.

Means for Solving the Problems

A wig according to a first aspect of the present invention comprises an alternate arrangement, the alternate arrangement including: a first region of a wig base in which a plurality of first hairs having a first curl diameter are implanted, the first hair being an artificial hair or a natural hair; and a second region of the wig base in which a plurality of second hairs having a second curl diameter smaller than the first curl diameter are implanted, the second hair being an artificial hair or a natural hair, the first and second regions being adjacent to each other and alternately arranged.

The wig in a second aspect of the present invention according to the first aspect comprises a plurality of alternate arrangements.

In the wig in a third aspect of the present invention according to the first or second aspect, the wig base is partitioned into a plurality of sections, one of the sections having the alternate arrangement, and another section having a second alternate arrangement, the second alternate arrangement including: a third region in which a plurality of third hairs having a third curl diameter different from the first curl diameter are implanted, the third hair being an artificial hair or a natural hair; and a fourth region in which a plurality of fourth hairs having a forth curl diameter smaller than the third curl diameter are implanted, the fourth hair being an artificial hair or a natural hair, the third and fourth regions being adjacent to each other and alternately arranged.

In the wig in a fourth aspect of the present invention according to the first or second aspect, the wig base is partitioned into a plurality of sections, one of the sections having the alternate arrangement, and another section having a third alternate arrangement, the third alternate arrangement including: the first region; and a fifth region in which a plurality of fifth hairs having a fifth curl diameter smaller than the first curl diameter and different from the second curl diameter are implanted, the fifth hair being an artificial hair or a natural hair, the first and fifth regions being adjacent to each other and alternately arranged.

In the wig in a fifth aspect of the present invention according to any one of the first to fourth aspects, the first region is formed along an outer periphery of the wig base.

In the wig in a sixth aspect of the present invention according to any one of the first to fifth aspects, the first curl diameter is in a range from 20 to 80 mm.

In the wig in a seventh aspect of the present invention according to any one of the first to sixth aspects, the second curl diameter is 40 to 70% of the first curl diameter.

In the wig in an eighth aspect of the present invention according to any one of the first to seventh aspects, a ratio of the width of the second region to the width of the first region is in a range from 1:1.5 to 1:4.

In the wig in a ninth aspect of the present invention according to any one of the first to eighth aspects, the first hairs are implanted in the first region at a density of 50 to 90 strands per square centimeter.

In the wig according to any one of the first to ninth aspects, the second hairs are implanted in the second region at a density of 50 to 90 strands per square centimeter.

Effects of the Invention

The wig according to the present invention includes the region where the hairs having a large curl diameter are implanted, and another region where the hairs having a small curl diameter are implanted, those regions being adjacent to each other and alternately arranged. Thus, the hairs having the large curl diameter can be surely prevented from falling over, which can surely provide the wig with the desired voluminous feeling.

BRIEF DESCRIPTION OF THE DRAWINGS

FIGS. 2A and 2B each are a diagram of the details of the hair pieces 1 and 2 implanted in one of a plurality of transverse filaments 8A of a net-like wig base 10 shown in FIG. 1, in which FIG. 2A shows the hair pieces 1 not supported by the hair pieces 2, and FIG. 2B shows some of the hair pieces 1 supported by the hair pieces 2;

EMBODIMENT FOR CARRYING OUT THE INVENTION

Figure 1:
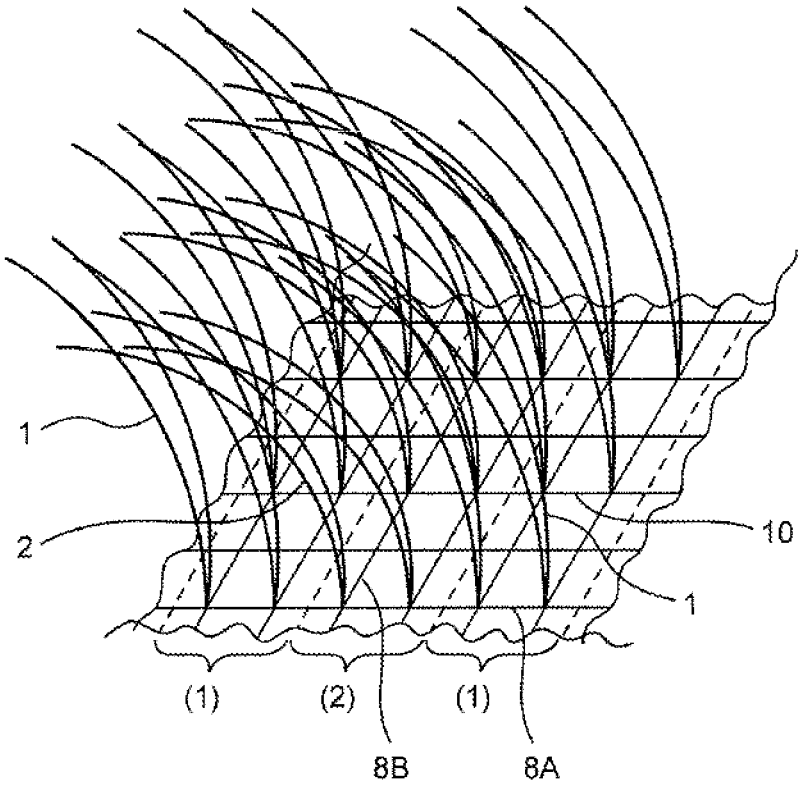
FIG. 1 is a schematic perspective view showing an alternate arrangement with alternating regions (1) and (2), each region (1) having hair pieces (hairs) with a first curl diameter implanted therein, and each region (2) having hair pieces (hairs) with a second curl diameter smaller than the first curl diameter implanted therein.

Preferred embodiments of the present invention will be described in detail below based on the accompanying drawings. In the description below, if necessary, the terms indicative of the specific direction or position (for example, "upper", "lower", "right", "left", "longitudinal", "transverse", and other words including these words) are used for easy understanding of the present invention with reference to the accompanying drawings. The meanings of the terms do not limit the technical scope of the present invention. The same parts or members are designated by the same reference numerals throughout the drawings.

FIG. 1 is a schematic perspective view showing an alternate arrangement included in a wig according to the present invention. The alternate arrangement includes a region (1) in which hair pieces (hairs) having a first curl diameter are implanted, and a region (2) in which hair pieces (hairs) having a second curl diameter smaller than the first curl diameter are implanted, the first and second regions being adjacent to each other and alternately arranged.

Figure 2A:
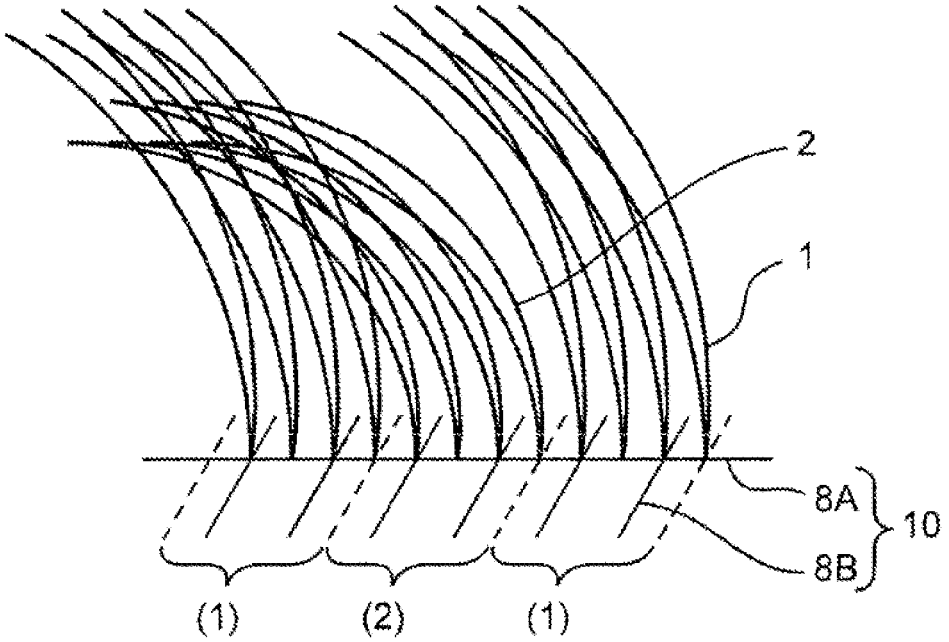
Figure 2B:
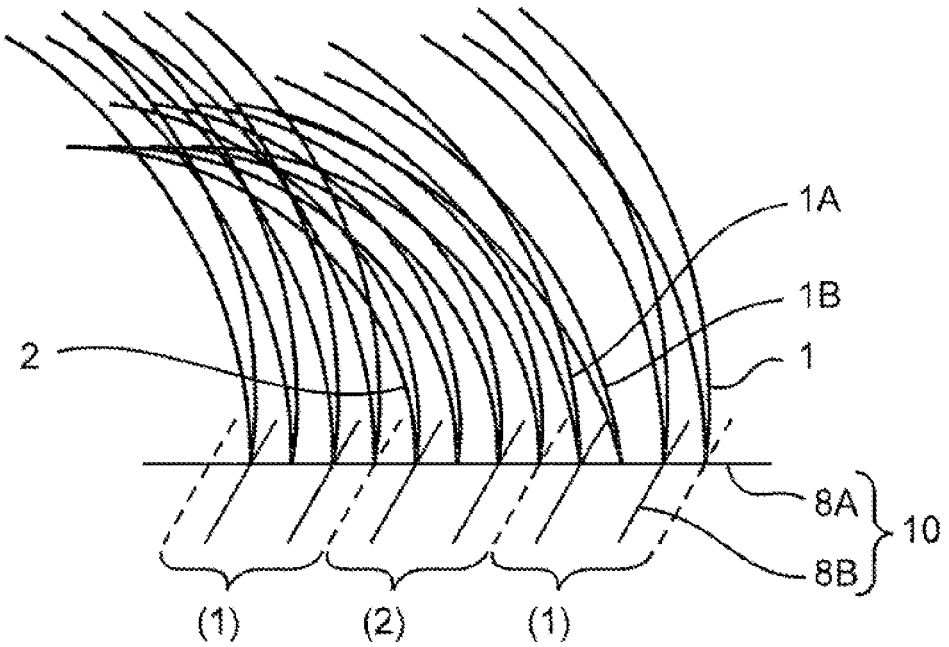

FIGS. 2A and 2B each are a diagram of the details of the hair pieces 1 and 2 implanted in one of a plurality of transverse filaments 8A of a net-like wig base 10 shown in FIG. 1, in which FIG. 2A shows the hair pieces 1 not supported by the hair pieces 2, and FIG. 2B shows some of the hair pieces 1 supported by the hair pieces 2.

In FIGS. 1 and 2, the regions (1) and (2) are indicated by dotted lines for easy identification.

If the amounts of hair pieces 1 and 2 shown in the figure are large, FIG. 1 would become complicated, making it difficult to view and recognize the position of implantation and the curled state of the hair pieces. Thus, FIG. 1 omits some hair pieces 1 and 2 (specifically, in the wig base 10, the hair pieces 1 and 2 implanted in parts where the transverse filament 8A intersects another longitudinal filament 8B are shown, but the hair pieces 1 and 2 implanted in other parts located on the transverse filament 8A and which do not intersect the longitudinal filament 8B are omitted).

In the regions (1) and (2), the hairs (hair pieces) are implanted on the base 10.

The plurality of (a number of) hair pieces 1 implanted in the region (1) respectively have a relatively large curl diameter.

The hair pieces 1 disposed in one region (1) have the same curl diameter.

The term "same curl diameter" as used in the present specification means the same curl diameter in terms of industry. Specifically, the term "same curl diameter" means that the curl diameter of every hair piece is within about ±10% from an arithmetic average of the curl diameters of the hair pieces disposed in the same region (when the number of hair pieces is 20 or more, the average of the curl diameter of any 20 hair pieces selected may be used).

The curl diameter of the hair piece can be determined by placing a hair piece on a flat plate after removing the hair piece 1 from the wig base 10, and measuring the diameter of a substantial circular shape of the hair piece formed on the flat plate.

The curl diameter of the hair piece 1 is preferable in a range from 20 to 80 mm. When the curl diameter of the hair piece 1 is within the above range, the sufficient voluminous feeling can be obtained, and the hair pieces 2 can easily support the hair pieces 1.

The plurality of (a number of) hair pieces 2 implanted in the region (2) have a smaller curl diameter than that of the hair pieces 1 in the region (1). The hair pieces 2 disposed in one region (2) have the same curl diameter.

The curl diameter of the hair piece 2 is preferable in a range from 40 to 70% of that of the hair piece 1, and more preferable in a range from 50 to 60%. The hair pieces 2 having a curl diameter in the above range can surely support the hair pieces 1.

The ratio of the curl diameter of the hair piece 1 to that of the hair piece 2 can be determined by comparing the respective averages of the curl diameters of the hair pieces 1 and 2 (for example, the averages of the measured curl diameters of any selected 20 hairs of each type removed from the wig base 10 (all the hairs when the number of the hair pieces disposed in the same sized regions (1) and (2) is less than 20)).

The regions (1) and (2) are adjacent to each other and alternately arranged to form the alternate arrangement. The term "alternate arrangement" as used herein means there are two or more regions of at least one kind of the regions (1) and (2) adjacent to each other as shown in FIG. 1.

The present inventors have found that the provision of the alternate arrangement can increase the voluminous feeling of the hairs implanted in the wig base.

This is supposed to be based on the following reasons.

The hair piece 1 having a large curl diameter substantially vertically stands up from a base end (wig base 10) according to the curl diameter, and gradually expands outward to its tip (toward the side, or leftward shown in FIGS. 1 and 2).

Thus, the hair piece 1 can reach the higher level position with respect to the base end (wig base) to exhibit the more excellent voluminous feeling.

The hair pieces with a large curl diameter disadvantageously tend to fall over due to the external force, such as wind, as compared to the hair pieces having the same length and a small curl diameter. When the hair piece falls over, an extra hair piece cannot be supplied from the wig base (base end) to the high level position, thus making it difficult to exhibit the sufficient voluminous feeling.

On the other hand, the hair piece 2 has the small curl diameter. After standing up from the base end (wig base 10), the hair piece 2 extends outward (toward the side, leftward in the FIGS. 1 and 2) to its tip without reaching the high-level position, unlike the hair piece 1. Thus, the hair pieces 2 will less contribute to the improvement of the voluminous feeling than the hair pieces 1.

However, even upon being subjected to the external force, the hair pieces 2 are advantageously unlikely to fall over.

The region (1) with the hair pieces 1 implanted therein and the region (2) with the hair pieces 2 implanted therein are alternately arranged, whereby the hair pieces 2 having a small curl diameter support the hair pieces 1 even when the hair pieces 1 are inclined due to external force or the like, thereby preventing the hair pieces 1 from falling over. As a result, sufficient voluminous feeling can be ensured.

The support of the hair pieces 1 by the hair pieces 2 will be exemplarily shown in FIG. 2.

FIG. 2A shows the state in which the external force is not applied to the hair pieces 1 and the hair pieces 2. The hair pieces 1 and 2 do not fall over. Thus, the hair pieces 2 do not support the hair pieces 1.

As shown in FIG. 2B, the external force (force for causing the hair pieces to fall over leftward in the figure) acts on the hair pieces 1 and 2.

The hair pieces 2 having a small curl diameter are hardly influenced by the external force, and thus are not inclined. On the other hand, the hair pieces 1 having a large curl diameter is easily inclined by the external force. As shown in FIG. 2B, among the hair pieces 1, some hair pieces 1A and hair pieces 2A are inclined leftward by the external force.

However, the hair pieces 2 come into contact with the hair pieces 1 (especially, into contact with portions thereof close to the base end), so that the hair pieces 2 support the hair pieces 1A and 1B. Thus, the hair pieces 1A and 1B are not inclined any more, and thus can sufficiently contribute to the improvement of the voluminous feeling. For example, in an example shown in FIG. 2B, although the hair pieces 1A and 1B are inclined, the tips of the hair pieces 1A and 1B are located at the higher level than the tips of the hair pieces 2, which contributes to the improvement of voluminous feeling.

In FIG. 2A showing the state where the hair pieces 1 (including the hair pieces equivalent to hair pieces 1A and 1B shown in FIG. 2B) are not inclined, it is obvious that the tip of the hair piece 1 is located at the higher level than the tip of the hair piece 2, which contributes to the improvement of the voluminous feeling.

As mentioned above, in the related art, the wig in which the mixture of the hairs having different curl diameters is implanted is known, but cannot exhibit the sufficient voluminous feeling in many cases.

This is because the hairs with two kinds of curl diameters are mixed in a random manner, and basically one hair piece having a large curl diameter is supported by one hair piece having a small curl diameter. Even when the hair piece having a large curl diameter is inclined in a direction slightly different from a direction in which the hair piece having a small curl diameter is positioned, the hairpiece having the small curl diameter cannot support the hair piece having the large curl diameter. Additionally, the hair piece having the large curl diameter inclined is supported only by one hair piece having the small curl diameter, and thus cannot be supported sufficiently, so that the hair piece having the large curl diameter might fall over.

On the other hand, in the present invention, for example, as shown in FIG. 1, when the hairs in the region (1) positioned on the right side are inclined leftward not only in a direction parallel to the filament 8A, but also in a direction deviating from the above-mentioned direction, the hair pieces 2 implanted in a direction parallel to the filament 8B in the region (2) shown in FIG. 1 can surely support the hair pieces 1 as long as the hair pieces 2 are inclined in a direction toward any part of the inside of the strip-like region (2).

Further, the inclined hair 1 can be supported by a plurality of hair pieces 2, which can surely prevent the hair pieces 1 from falling over.

When another region (2) is also disposed on the further right side of the region (1) located on the right side of FIG. 1 (that is, the region (2) is arranged on both sides of the region (1)), the hair pieces 1 located in the region (1) can be supported by the region (2) and prevented from falling over even if the hair pieces 1 are inclined in either left or right direction.

The above-mentioned mechanism is a mechanism estimated based on findings obtained by the present inventors that the provision of the alternate arrangement with alternating regions (1) and (2) improves the voluminous feeling of the hairs. Therefore, the mechanism is not intended to limit the scope of the present invention.

The details of each element included in the alternate arrangement will be described below.

As the wig base 10 having the regions (1) and (2) formed therein, various types of wig bases for use in wigs may be used, which include an artificial skin made of synthetic resin, such as urethane, a net-like wig base with meshes of fibers, such as synthetic fibers, or a combination of the artificial skin and the net.

In an example shown in FIG. 1, a net-like wig base with rectangular meshes is used in which the filaments 8A extending in the transverse direction and the filaments 8B extending in the longitudinal direction are arranged perpendicular to each other. For example, various well-known kinds of net shapes, such as a mesh structure with meshes having a hexagonal shape, may be used.

The regions (1) and (2) provided in the wig base 10 will be described below.

As mentioned above, the wig according to the present invention includes the alternate arrangement with alternating regions (1) and (2), which are adjacent to each other. The wig according to the present invention includes at least one alternate arrangement, preferably, a plurality of alternate arrangements.

The plurality of alternate arrangements can obtain the desired voluminous feeling of the hairs by the respective arrangements.

Preferably, the region (1) and the region (2) each have a width of 3 mm or more and 15 mm or less. For the width of 3 mm or more, the region (2) can surely support the hair pieces 1 located in the region (1), so that the hair pieces in the region (1) can surely exhibit the adequate voluminous feeling. For the width of 15 mm or less, the hair pieces 1 and the hair pieces 2 are difficult to separate and distinguish as viewing the wig, which can eliminate the possibility that the wig is recognized by a third party.

The term "width" as used herein means the length of each region (1) and (2) in the direction alternately arranging the regions (1) and (2).

The hairs (1) and hairs (2) may be artificial hairs made of synthetic resin, such as polyamide resin, or natural hairs, such as human hairs.

In the example shown in FIGS. 1 and 2, one hair material for use is folded substantially in half at its center, and the substantial center of the hair material is wound around and bonded to the filament forming the net of the wig base 10

(note that in the figures, the details of a bonded part are omitted). Thus, one hair material produces two hair pieces 1 or hairpieces 2 located on one end and the other end of the material.

However, the form of the wig is not limited thereto. Alternatively, one end of one hair piece may be fixed to a wig base, and the other end thereof may serve as a free end to produce one hair piece 1 or hair piece 2.

In the region (1), preferably, 50 to 90 strands of the hair piece 1 per square centimeter are implanted. That is, when one hair material is folded in half and implanted to produce two hair pieces 1 as shown in FIG. 1, 25 to 45 hair materials per square centimeter are implanted.

Implanting of the hair pieces 1 at a density within this range enables natural looking and voluminous feeling.

In the region (2), preferably, 50 to 90 strands of the hair piece 2 per square centimeter are implanted. That is, when one hair material is folded in half and implanted to produce two hair pieces 2 as shown in FIG. 1, 25 to 45 hair materials per square centimeter are implanted.

Implanting of the hair pieces 2 at a density within this range enables natural looking and sure supporting of the hair pieces 1.

The hair pieces 1 and hair pieces 2 may be implanted in the wig base 10 by various types of means known as means for fixing the hairs to the wig base, including connection and bonding.

In the embodiment shown in FIG. 1, the hair pieces 1 and 2 are arranged and implanted along the filaments 8A in the transverse direction or the filaments 8B in the longitudinal direction. Alternatively, except for the above arrangement, various arrangements may be applied to the implantation of the hair pieces. For example, the hair pieces may be implanted to form a staggered arrangement. The hair pieces may be arranged based on a regular pattern but not be implanted in some positions on purpose to disrupt the regular pattern, making the hair pieces more natural or implanting the hair pieces in a random manner.

The hair pieces 1 implanted in the region (1) and the hair pieces 2 implanted in the region (2) may be formed of the same material or different materials.

The hair pieces 1 implanted in the region (1) and the hair pieces 2 implanted in the region (2) may have the same thickness or different thicknesses.

The hair pieces 1 implanted in the region (1) and the hair pieces 2 implanted in the region (2) may have the same length or different lengths.

When the hairs 1 and 2 are formed of the same material in the same length, the same hair material (or hair piece) can be used to provide the hair pieces 1 and 2 only by changing the applied curl diameter, which can produce the wig according to the present invention with high productivity.

On the other hand, the hair piece 1 and hair piece 2 are formed to have different appropriate lengths to thereby produce a natural silhouette, which can reduce the possibility that the wig is recognized by the third party.

The respective tips of the hair pieces 1 implanted in one region (1) may be directed in the same direction or different directions according to the positions of the respective hair pieces of the wig.

Likewise, the respective tips of the hair pieces 2 implanted in one region (2) may be directed in the same direction or different directions according to the positions of the respective hair pieces of the wig.

Figure 3:
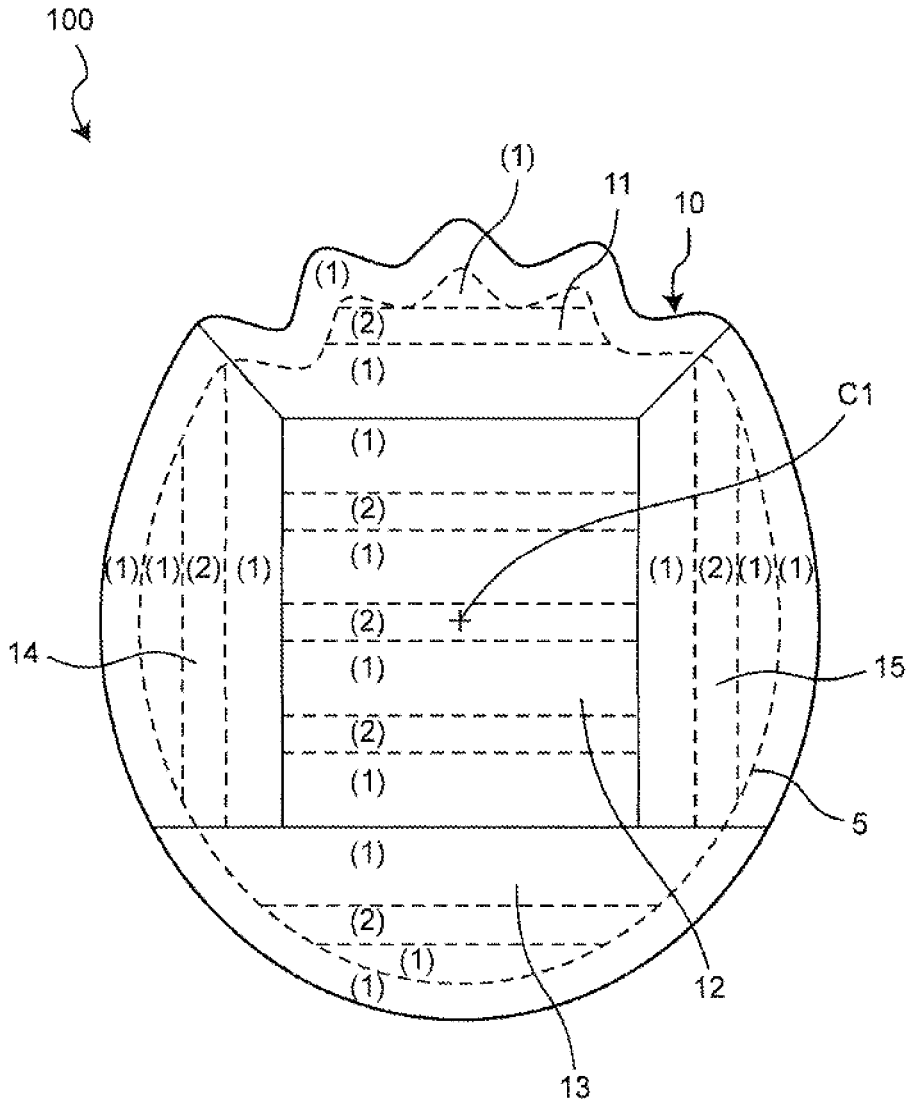
FIG. 3 is a top view of a wig 100 including the alternate arrangement according to the present invention.

FIG. 3 shows a top view of a wig 100 including the alternate arrangement in the present invention.

Like FIGS. 1 and 2, FIG. 3 indicates the regions (1) and (2) by dotted lines for clear identification.

The wig according to the present invention is preferably partitioned into a plurality of sections, each section having the alternate arrangement.

The hairs growing at the heads of human are not the same but different in thickness, number (density), and curled degree depending on the position of the hairs in the head. The sections are provided for the purpose of finishing the natural wig by being modeled on such a human head. The sections respectively represent areas which differ in at least one of the flow of the tip of the hair, the density of the hairs, the curl diameter, the length of the hair, and the color of the hair.

FIG. 3 shows boundaries between the respective sections by solid lines. The wig 100 includes five sections, namely, a frontal area 11, an occipital area 13, a top area 12, a left temporal area 14, and a right temporal area 15.

In each section, the regions (1) and (2) are adjacent to each other and alternately arranged to form the alternate arrangement.

The region (1) has the hair pieces 1 implanted therein, and the region (2) has the hair pieces 2 implanted therein. For easy identification of the arrangement of the regions (1) and (2) and the arrangement of the sections, FIG. 3 omits the illustration of the hair pieces (hairs) 1 and the hair pieces (hairs) 2.

At least one or more of the length, color, curl diameter, implantation density, and thickness of the hair pieces 1 and 2 for use may be changed in every section. These factors can be changed for each section to meet the requests of a wearer.

The changing of the curl diameter for each section will be described in detail below.

When the wig has the plurality of sections, the curl diameters of the hair pieces 1 in the regions (1) of each section may be different. Alternatively, the hair pieces 1 of some sections may have the same curl diameter, and the hairpieces 1 in any sections other than the sections may have different curl diameters.

Likewise, as long as the hair piece 2 in the region (2) has a curl diameter smaller than that of the hair piece 2 in the region (1) within the same section, the curl diameters of the hair pieces 2 in the regions (2) of each section may be different. Alternatively, the hair pieces 2 of some sections may have the same curl diameter, and the hair pieces 2 in any sections other than the sections may have different curl diameters.

By way of example of the wig 100 shown in FIG. 3, the frontal area 11, occipital area 13, top area 12, left temporal area 14, and right temporal area 15 have the hair pieces 1 in the regions (1) having different curl diameters from each other. In addition to or instead of this, the hair pieces 2 in the regions (2) may differ in curl diameter among the areas.

The hair pieces 1 in the regions (1) of the left temporal area 14 and right temporal area 15 have the same curl diameter, but the hair pieces 1 in the regions (1) of the frontal area 11, occipital area 13 and top area 12 have different curl diameters from that of each hair piece 1 in other sections. The hair pieces 1 in some sections may have the same curl diameter as that of the hair pieces 1 in other sections.

Likewise, the hair pieces 2 in the regions (2) of the left temporal area 14 and right temporal area 15 have the same curl diameter, but the hair pieces 2 in the regions (2) of the frontal area 11, occipital area 13 and top area 12 have different curl diameters from that of each hair piece 2 in other sections. The hair pieces 2 in some sections may have the same curl diameter as that of the hair pieces 2 in other sections.

Preferably, the wig according to the present invention is provided with the region (1) disposed along the outer periphery of the wig base. That is, as shown in FIG. 3, the wig 100 includes the region (1) located between an inner peripheral line 5 formed along an outer periphery of the wig base 10 and the outer periphery thereof.

In this way, the hair pieces 1 having a large curl diameter are implanted in the outer periphery of the wig 100, which can reduce the possibility that the wig is recognized by the third party.

In particular, when the wig is attached on the head of a wearer with his/her own natural hairs remaining, the hair pieces 1 having the large curl diameter and the wearer's own natural hairs are easily blended (easily mixed), which can greatly eliminate the possibility that the wig is recognized by the third party.

The width of the region (1) and the width of the region (2) may be determined, for example, for each section. Preferably, when the width of the region (2) is "1", the width of the region (1) is preferably set in a range from 1.5 to 4. This is because there can be provided more regions (1) in which the hair pieces 1 having a large curl diameter for increasing voluminous feeling are implanted, and enough hair pieces 2 to support the hair pieces 1.

More preferably, when the width of the region (2) is 1, the width of the region (1) is about 2.

For example, at the top area 12 shown in FIG. 3, the regions (1) having a width of 10 mm and the regions (2) having a width of 5 mm are adjacent to each other and alternately arranged from the frontal direction of the wig base 10 toward the occipital direction through the center C1 of the wig base.

The occipital area 13, left temporal area 14 and right temporal area 15 each have the region (1) formed at a width of 5 mm from the outer periphery of the wig base 10 along the outer periphery of the wig base 10 from the center C1 of the wig base 10, and have its width reducing upward or downward from the center (the maximum width of about 5 mm) (that is, two regions (1) are collected to form the region (1) having a width of 5 to 10 mm). Then, the regions (2) each having a 5 mm width and the regions (1) each having a 10 mm width are alternately arranged.

FIG. 3 shows only the minimum number of the regions (1) and (2) that represent the alternate arrangement of the regions (1) and (2) included in each section, from the viewpoint of space saving of the paper in the alternate arrangement with the regions (2) and (1) in the sections 11 to 15.

It is noted that in the respective sections, actually, the more numbers of regions (2) and (1) than those shown in FIG. 3 may be alternately arranged.

The frontal area 11 has the region (1) formed in a width of 5 mm from the outer periphery of the wig base 10 along the outer periphery of the wig base 10 toward the center C1 of the wig base 10. The frontal area 11 also has another region (1) having a complicated shape with three wide portions (in a maximum width of about 5 mm) (that is, two regions (1) are mixed into the region (1) having a width of 5 to 10 mm). Then, the regions (2) having a 5 mm width and the regions (1) having a 10 mm width are alternately arranged.

That is, every sections 11 to 15 satisfies the above mentioned preferable ratio of the width of the region (2) to that of the region (1) of 1:1.5 to 1:4 and the above mentioned more preferable ratio of 1:2.

Figure 4:
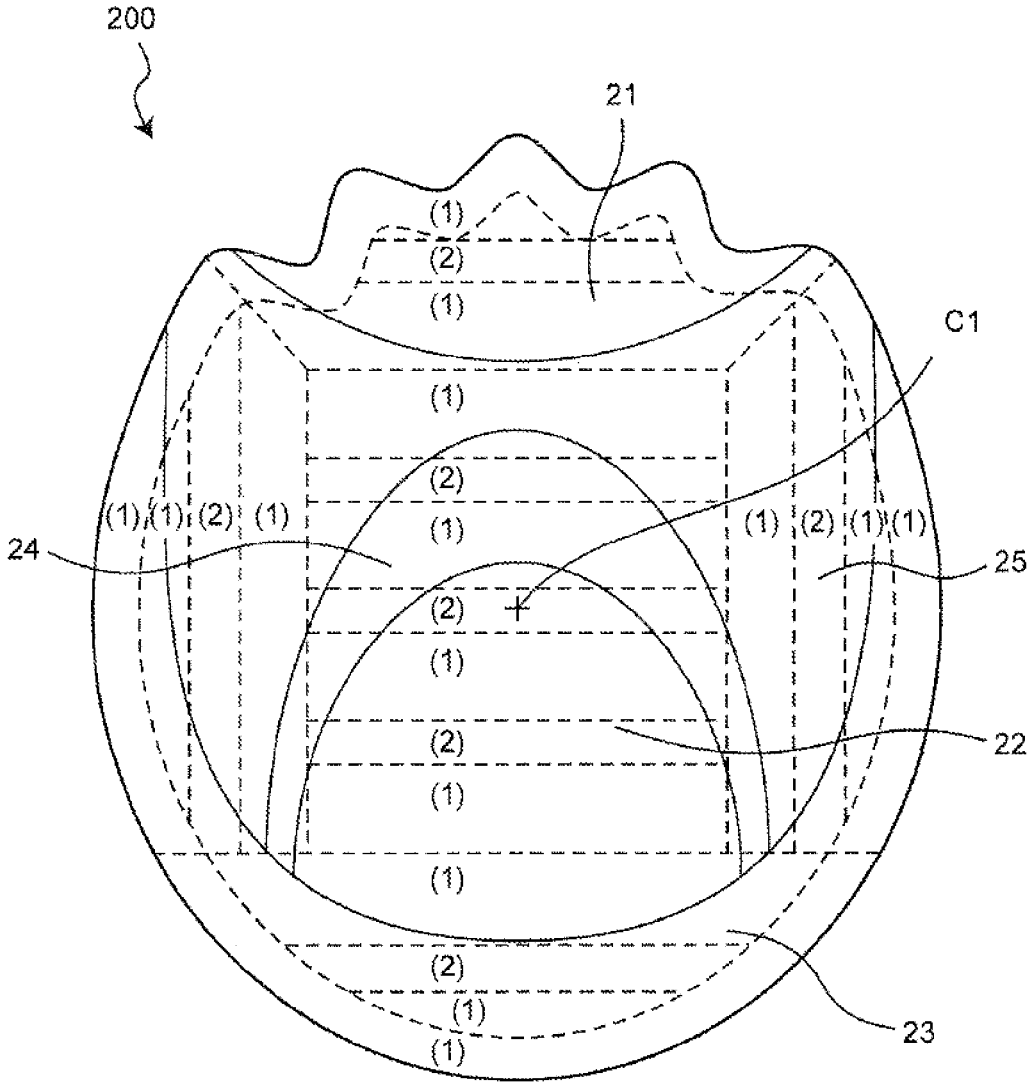
FIG. 4 is a top view of a wig 200 having different sections from those of the wig 100.

FIG. 4 is a top view of a wig 200 having different sections from those of the wig 100. Like FIG. 3, FIG. 4 illustrates boundaries between the sections by solid lines.

Unlike the wig 100, the wig 200 includes five sections with the boundaries therebetween indicated by curved lines, namely, a forehead area 21, an occipital area 22, a side peripheral area 23, a parietal area 24 and a frontal area 25.

Unlike the five sections shown in FIG. 3, such arrangement of sections comply with the shape of the human head, which can surely avoid a part of the hairs implanted or unnatural appearance that might reveal a wig at first glance, and can also produce a satisfactory wig tailored to the desired number (density), length, color and curl form of thin hairs.

Each of the sections (21) to (25) has the alternate arrangement in which the regions (1) to (2) are adjacent to each other and alternately arranged.

The arrangement of the regions (1) and (2) in the sections 21 to 25 may be arbitrarily determined according to the shape of each section.

Alternatively, as shown in FIG. 4, the same arrangement as that of the wig 100 may be used as it is.

In this case, one region (1) and one region (2) enclosed by dotted lines as shown in FIG. 4 lie in two or more sections.

In the region (1) lying across the sections, the hairpieces 1 have the curl diameter, length, color, implantation density and thickness determined in each section. When these properties differ among the sections, the different kinds of hair pieces 1 can be implanted according to the section within one region (1) enclosed by the dotted line.

Likewise, in the region (2) lying across the sections, the hair pieces 1 have the curl diameter, length, color, implantation density and thickness determined in each section. When these properties differ among the sections, the different kinds of hair pieces 2 can be implanted according to the section within one region (2) enclosed by the dotted line.

That is, one region (1) enclosed by the dotted line substantially covers a plurality of regions (1) partitioned by the boundary lines between the respective sections. Likewise, one region (2) enclosed by the dotted line substantially covers a plurality of regions (2) partitioned by the boundary lines between the respective sections.

Methods for manufacturing the wig 100 and 200 will be described below.

The following manufacturing method is illustrative only, and does not intend to limit the manufacturing method of the present invention.

First, the wig base 10 is manufactured in the following way.

When the wig base is a net-like wig base formed using a net fabric as the material, a desired net is arranged and fixed over a plaster cast of a head-shaped positive die for a wearer. Then, in order to easily respond to the shape of the plaster cast from above the net and to have good retention property, resin, such as urethane, is dissolved into an organic solvent to form a resin solution, which is then applied to the net and dried. The resin is then removed from the plaster cast to thereby produce a wig base corresponding to the shape of the head of the wearer.

When the wig base is the so-called artificial skin formed using a synthetic resin sheet material as the material, a resin solution produced by solving the synthetic resin in an organic solvent is applied and dried. The resin is then removed from a plaster cast of the head-shaped positive die for a wearer to thereby produce a wig base corresponding to the shape of the head of the wearer. Alternatively, a synthetic resin sheet is put and fixed onto a plaster cast of the head-shaped positive die for a wearer, and then heated to deform the resin into the shape of the plaster cast. Then, the resin is removed from the plaster cast to thereby produce a wig base corresponding to the shape of the head of the wearer.

The resin used at this time is preferably a thermoplastic elastomer, such as polyurethane or silicone, having the flexibility.

Then, hair pieces or hair materials (each of which is a hairs for use to obtain two hair pieces by being folded in half, and which is in a state before folding in half) to be used in the hair piece 1 or 2 is prepared.

The hair pieces (or hair material) for use may be the well-known artificial hairs, such as artificial hairs made of polyamide resin or the like, or natural hairs, such as human hairs, or a combination thereof.

The hair pieces or hairs have the quality of material, thickness, length, color and the like appropriate for the hair pieces 1 and hair pieces 2 (the hair pieces 1 and 2 in each section, when the wig has sections).

The curl diameter of the hair pieces 1 and 2 may be set to a desired value by making curl on the hair pieces 1 and 2 implanted in the wig base 10 by heating with a dryer or the like.

Preferably, however, for example, before implanting the hair pieces in the wig base 10, the hair pieces or hair materials are wound around a pipe with a desired diameter, and then are heated and kept, so that the hair pieces previously have the predetermined curl diameter.

This is excellent in productivity as compared to the case where the hair pieces are curled to have different curl diameters, such as the first curl diameter or second curl diameter, for each region after the implantation.

Then, the hair pieces (or hair materials) prepared are implanted in the wig base 10.

The wig base 10 is made to be capable of identifying the sections (to be provided), the regions (1) and the regions (2) in advance, and then the appropriate hair pieces (hair materials) are implanted.

For example, as shown in FIG. 1, when the wig base 10 is a net and the hair pieces 1 and 2 are obtained by folding the hair material in half substantial at the center thereof, a folded point of the hair material folded in half can be connected to the filaments forming the net (for example, the filament 8A in the transverse direction and/or filament 8B in the longitudinal direction) using a crochet hook, so that the hair material 1 and the hair material 2 can be implanted.

Methods for bonding the hair material to the filament may include well-known methods for use in manufacturing a wig, for example, a method disclosed in JP 2007-92202 A.

When the wig base is an artificial skin, the following well-known method is used to connect the hair material to the wig base. Specifically, a crochet hook penetrates the wig base to cause a crochet part at its tip of the needle to hang on a loop part (folded part) of the hair material folded in half. Then the needle is rotated to cause the crochet part at its tip to hang on the free end side of the hair material without disengaging from the loop, and then to pass through the loop.

Methods for implanting hair pieces or material in the wig base is not limited thereto, and may include any well-known methods for use in manufacturing a wig, for example, methods including connection and bonding.

When the width of the region (1) or (2) is wide, one region may be partitioned into two or more small regions in the width direction. After implanting the hair pieces 1 or hair pieces 2 as a whole in one small region, the hair pieces 1 or hair pieces 2 may be further implanted into a next small region.

That is, for example, in the wig 100 shown in FIG. 3, in the case of implanting the hairs 1 in the region (1) of 1 cm in width in the sections 11, 12 and 13, for example, the section is partitioned into two small regions, each having a width of 5 mm. After implanting the necessary hair pieces 1 as a whole in one small region, the hair pieces 1 may be implanted in another small region.

In many cases the implantation is performed by hand using the crochet hook as mentioned above. When implanting the hair pieces (or hair material) in one wide region (for example, of about 5 mm or more in width), the case of partitioning the wide region into small regions can produce a better (natural) finished wig.

As mentioned above, when the hair material or hair piece implanted previously has a predetermined curl diameter, the wig according to the present invention can be obtained by the steps mentioned above.

On the other hand, when the hair piece (or hair material) is not previously curled, the curl is made every region (1) and region (2) using a dryer, a hair iron or the like such that the hair piece has a desired curl diameter. In this way, the wig according to the present invention can be obtained.

This application claims priority under the Paris Convention on Japanese Patent Application No. 2011-172678, the disclosure of which is incorporated by reference herein.

DESCRIPTION OF REFERENCE NUMERALS

1 Hair pieces
2 Hair pieces
5 Inner peripheral line
8A Filament in transverse direction
8A Filament in longitudinal direction
10 Wig base
11 Frontal area
12 Top area
13 Occipital area
14 Left temporal area
15 Right temporal area
100, 200 Wig

The invention claimed is:

1. A wig comprising:

a wig base including, a frontal area, an occipital area, a top area, a left temporal area and a right temporal area and an alternate arrangement including a first region of the wig base in which a plurality of first hairs having a first curl diameter are implanted, the first hair being an artificial hair or natural hair, and a second region of the wig base in which a plurality of second hairs having a second curl diameter smaller than the first curl diameter are implanted, the second hair being an artificial hair or natural hair, the first and second regions being adjacent to each other and alternately arranged, wherein each of the frontal area, occipital area, top area, left temporal area and right temporal area include the alternate arrangement and at least one of a length, color, curl diameter, implantation density, and thickness of the first hairs and the second hairs of one of the areas is different from that of the first hairs and the second hairs of at least one of the other areas, and the first region of the alternate arrangement of the frontal area, the first region of the alternate arrangement of the occipital area, the first region of the alternate arrangement of the left temporal area and the first region of the alternate arrangement of the right temporal area are disposed along an outer periphery of the wig base.

2. The wig according to claim 1, wherein the first curl diameter is in a range from 20 to 80 mm.

3. The wig according to claim 1, wherein the second curl diameter is 40 to 70% of the first curl diameter.

4. The wig according to claim 1, wherein a ratio of the width of the second region to the width of the first region is in a range from 1:1.5 to 1:4.

5. The wig according to claim 1, wherein the first hairs are implanted in the first region at a density of 50 to 90 strands per square centimeter.

6. The wig according to claim 1, wherein the second hairs are implanted in the second region at a density of 50 to 90 strands per square centimeter.

7. The wig according to claim 1, wherein at least one of the first curl diameter and the second curl diameter of one of the areas is different from that of at least one of the other areas.

8. The wig according to claim 1, wherein each of the areas includes a boundary therebetween having a curved line in a planar view.

9. A wig comprising:

a wig base including a frontal area, an occipital area, a top area, a left temporal area and a right temporal area; and an alternate arrangement including a first region of the wig base in which a plurality of first hairs having a first curl diameter are implanted, the first hair being an artificial hair or natural hair, and a second region of the wig base in which a plurality of second hairs having a second curl diameter smaller than the first curl diameter are implanted, the second hair being an artificial hair or natural hair, the plurality of second hairs having substantially the same length as a length of the plurality of first hairs, the first and second regions being adjacent to each other and alternately arranged, wherein each of the frontal area, occipital area, top area, left temporal area and right temporal area include the alternate arrangement and at least one of a length, color, curl diameter, implantation density, and thickness of the first hairs and the second hairs of one of the areas is different from that of the first hairs and the second hairs of at least one of the other areas, and the first region of the alternate arrangement of the frontal area, the first region of the alternate arrangement of the occipital area, the first region of the alternate arrangement of the left temporal area and the first region of the alternate arrangement of the right temporal area are disposed along an outer periphery of the wig base.

* * * * *